US010784095B2

(12) United States Patent
Smith et al.

(10) Patent No.: US 10,784,095 B2
(45) Date of Patent: Sep. 22, 2020

(54) MULTIDIMENSIONAL DYNODE DETECTOR

(71) Applicant: Thermo Finnigan LLC, San Jose, CA (US)

(72) Inventors: Johnathan W. Smith, Round Rock, TX (US); Scott T. Quarmby, Round Rock, TX (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 16/224,593

(22) Filed: Dec. 18, 2018

(65) Prior Publication Data

US 2020/0194245 A1 Jun. 18, 2020

(51) Int. Cl.

| | |
|---|---|
| ***H01J 49/00*** | (2006.01) |
| ***H01J 49/02*** | (2006.01) |
| ***H01J 49/42*** | (2006.01) |

(52) U.S. Cl.

CPC ..... *H01J 49/025* (2013.01); *H01J 49/0031* (2013.01); *H01J 49/4225* (2013.01)

(58) Field of Classification Search

CPC ..... H01J 49/00; H01J 49/02; H01J 49/022; H01J 49/025; H01J 49/26; H01J 49/06; H01J 49/062; H01J 43/06; H01J 43/10; H01J 43/16; H01J 43/18; H01J 43/20; H01J 43/22; H01J 43/24; H01J 43/243; H01J 43/246

USPC ..... 250/281, 282

See application file for complete search history.

(56) References Cited

U.S. PATENT DOCUMENTS

| | | | |
|---|---|---|---|
| 5,416,382 | A | 5/1995 | L'Hermite |
| 6,707,034 | B1 | 3/2004 | Yamaguchi et al. |
| 7,456,398 | B2 | 11/2008 | Senko et al. |
| 8,389,929 | B2 | 3/2013 | Schoen et al. |
| 8,519,327 | B2 | 8/2013 | Izumi |
| 9,269,552 | B2 | 2/2016 | Steiner et al. |
| 9,355,828 | B1 | 5/2016 | Smith et al. |

(Continued)

FOREIGN PATENT DOCUMENTS

| | | |
|---|---|---|
| EP | 0611169 A1 | 8/1994 |
| EP | 2720012 A2 | 4/2014 |

(Continued)

OTHER PUBLICATIONS

Batsala et al., "Inductively Coupled Plasma Mass Spectrometry (ICP-MS)", International Journal of Research in Pharmacy and Chemistry, vol. 2 (2) , pp. 661-670.

(Continued)

*Primary Examiner* — Jason L McCormack

(74) *Attorney, Agent, or Firm* — David A. Schell

(57) ABSTRACT

A mass spectrometer is described that includes a multipole configured to pass an ion stream, the ion stream comprising an abundance of one or more ion species within stability boundaries defined by (a, q) values. A detector formed by a plurality of dynodes is configured to detect the spatial and temporal properties of the abundance of ions, where each dynode arranged such that it is struck by ions in a known spatial relationship with the ion stream. The detector also includes a plurality of charged particle detectors, each associated with one or more of the plurality of dynodes. A processing system is configured to record and store a pattern of detection of ions in the abundance of ions by the dynodes in the detector.

15 Claims, 9 Drawing Sheets

(56) References Cited

U.S. PATENT DOCUMENTS

| | | | | |
|---|---|---|---|---|
| 10,236,172 | B2 | 3/2019 | Hunter et al. | |
| 2008/0258619 | A1* | 10/2008 | Bascle | H01J 43/04 313/533 |
| 2014/0151549 | A1* | 6/2014 | Steiner | H01J 43/18 250/288 |

FOREIGN PATENT DOCUMENTS

| | | | |
|---|---|---|---|
| EP | 3029712 | A1 | 6/2016 |
| WO | 2018/218308 | A1 | 12/2018 |

OTHER PUBLICATIONS

Dass, "Mass Analysis and ion Detection", in "Fundamentals of Contemporary Mass Spectrometry", Wiley-Interscience, 2007, Chapter 3, pp. 67-117.

* cited by examiner

MULTIDIMENSIONAL DYNODE DETECTOR

TECHNICAL FIELD

The present disclosure is directed to the field of mass spectrometry. More particularly, the present disclosure relates to a mass spectrometer system and method that provides for improved high mass resolving power (MRP) and sensitivity via deconvolution of the spatial and temporal characteristics collected at the exit aperture of a quadrupole instrument.

BACKGROUND

Quadrupole mass analyzers are one type of mass analyzer used in mass spectrometry. As the name implies, a quadrupole consists of four rods, usually cylindrical or hyperbolic, set in parallel pairs to each other, as for example, a vertical pair and a horizontal pair. These four rods are responsible for selecting sample ions based on their mass-to-charge ratio (m/z) as ions are passed down the path created by the four rods. Ions are separated in a quadrupole mass filter based on the stability of their trajectories in the oscillating electric fields that are applied to the rods. Each opposing rod pair is connected together electrically, and a radio frequency (RF) voltage with a DC offset voltage is applied between one pair of rods and the other. Ions travel down the quadrupole between the rods. Only ions of a certain mass-to-charge ratio will be able to pass through the rods and reach the detector for a given ratio of voltages applied to the rods. Other ions have unstable trajectories and will collide with the rods. This permits selection of an ion with a particular m/z or allows the operator to scan for a range of m/z-values by continuously varying the applied voltage.

By setting stability limits via applied RF and DC potentials that are capable of being ramped as a function of time, such instruments can be operated as a mass filter, such that ions with a specific range of mass-to-charge ratios have stable trajectories throughout the device. In particular, by applying fixed and/or ramped AC and DC voltages to configured cylindrical but more often hyperbolic electrode rod pairs in a manner known to those skilled in the art, desired electrical fields are set-up to stabilize the motion of predetermined ions in the x and y dimensions. As a result, the applied electrical field in the x-axis stabilizes the trajectory of heavier ions, whereas the lighter ions have unstable trajectories. By contrast, the electrical field in the y-axis stabilizes the trajectories of lighter ions, whereas the heavier ions have unstable trajectories. The range of masses that have stable trajectories in the quadrupole and thus arrive at a detector placed at the exit cross section of the quadrupole rod set is defined by the mass stability limits.

Typically, quadrupole mass spectrometry systems employ a single detector to record the arrival of ions at the exit cross section of the quadrupole rod set as a function of time. By varying the mass stability limits monotonically in time, the mass-to-charge ratio of an ion can be (approximately) determined from its arrival time at the detector. In a conventional quadrupole mass spectrometer, the uncertainty in estimating of the mass-to-charge ratio from its arrival time corresponds to the width between the mass stability limits. This uncertainty can be reduced by narrowing the mass stability limits, i.e. operating the quadrupole as a narrow-band filter. In this mode, the mass resolving power of the quadrupole is enhanced as ions outside the narrow band of "stable" masses crash into the rods rather than passing through to the detector. However, the improved mass resolving power comes at the expense of sensitivity. In particular, when the stability limits are narrow, even "stable" masses are only marginally stable, and thus, only a relatively small fraction of these reach the detector.

FIG. 1A shows example data from a Triple Stage Quadrupole (TSQ) mass analyzer to illustrate mass resolving power capabilities presently available in a quadrupole device. As shown in FIG. 1A, the mass resolving power that results from the example detected m/z 508.208 ion is about 44,170, which is similar to what is typically achieved in "high resolution" platforms, such as, Fourier Transform Mass Spectrometry (FTMS). To obtain such a mass resolving power, the instrument is scanned slowly and operated within the boundaries of a predetermined mass stability region. Although the mass resolving power (i.e., the intrinsic mass resolving power) shown by the data is relatively high, the sensitivity, while not shown, is very poor for the instrument.

FIG. 1B (see inset) shows Q3 intensities of example m/z 182, 508, and 997 ions from a TSQ mass analyzer operated with a narrow stability transmission window (data denoted as A) and with a wider stability transmission window (data denoted as A'). The data in FIG. 1B is utilized to show that the sensitivity for a mass selectivity quadrupole can be increased significantly by opening the transmission stability window. However, while not explicitly shown in the figure, the intrinsic mass resolving power for a quadrupole instrument operated in such a wide-band mode often is undesirable.

The key point to be taken by FIGS. 1A and 1B is that conventionally, operation of a quadrupole mass filter provides for either relatively high mass resolving power or high sensitivity at the expense of mass resolving power but not for both simultaneously and in all cases, the scan rate is relatively slow.

More recently quadrupole mass spectrometry systems have been developed that allow for the resolution of ion exit patterns at the detector. Such a system is described in U.S. Patent Application No. 2011/0215235, entitled, "QUADRUPOLE MASS SPECTROMETER WITH ENHANCED SENSITIVITY AND MASS RESOLVING POWER," published Sep. 8, 2011, by Schoen et al., the contents of which are hereby incorporated by reference. Instead of merely detecting the impact of an ion, the new systems allow for the detection of location of the impact on the detector using photo detectors. FIG. 2B shows an example of a detection plot displaying spatial information from the detector. The system is able widen the band of stable ions passing through the quadrupole and can discriminate among ion species, even when both are simultaneously stable, by recording where the ions strike a position-sensitive detector as a function of the applied RF and DC fields. When the arrival times and positions are binned, the data can be thought of as a series of ion images. Each observed ion image is essentially the superposition of component images, one for each distinct m/z value exiting the quadrupole at a given time instant. Because the present disclosure provides for the prediction of an arbitrary ion image as a function of m/z and the applied field, each individual component can be extracted from a sequence of observed ion images by the mathematical deconvolution processes discussed herein. The mass-to-charge ratio and abundance of each species necessarily follow directly from the deconvolution. Unfortunately, the type of spectrometry system described by Schoen et al. requires very expensive detection components and processing and is not practical for many applications.

Accordingly, there is a need in the field of mass spectrometry to improve the mass resolving power using special information at the detector while simplifying detector components and design. The systems and methods disclosed herein address this need by measuring the ion current as a function of both time and relative spatial displacement in the beam cross-section and then deconvolving the contributions of the signals from the individual ion species.

BRIEF SUMMARY

The disclosure is directed to a novel quadrupole mass spectrometer that includes a quadrupole configured to pass an ion stream having an abundance of one or more ion species within stability boundaries defined by (a, q) values. A detector operates to detect the spatial and temporal properties of the abundance of ions using a plurality of dynodes. Each dynode is arranged such that it is struck by ions in a known spatial relationship with the ion stream. A plurality of charged particle detectors is associated with one or more of the plurality of dynodes to amplify the signal to each dynode, and a processing means records and stores a pattern of detection of ions in the abundance of ions by the dynodes in the detector.

In another aspect, a mass spectrometer provides temporal and spatial information with respect to an ion stream. The mass spectrometer includes a multipole configured to pass the ion stream that is formed by an abundance of one or more ion species within stability boundaries defined by (a, q) values. A plurality of dynodes detects the abundance of ions based on each ion's spatial location in the ion stream, where the plurality of dynodes includes a first dynode arranged to be struck by ions in the center of the ion stream, a second dynode being configured to be struck by ions in a y+ portion of the ion stream, a third dynode being configured to be struck by ions in a y− portion of the ion stream, a fourth dynode being configured to be struck by ions in a x+ portion of the ion stream, and a fifth dynode being configured to be struck by ions in a x-portion of the ion stream. In preferred embodiments the second dynode, third dynode, fourth dynode and fifth dynode are configured in a pyramidal arrangement with an aperture associated with the first dynode. A plurality of charged particle detectors are associated with one or more of the plurality of dynodes, and a processor records and stores a pattern of detection of ions in the abundance of ions by the plurality of dynodes in the detector.

In yet another aspect, a method of operating a mass spectrometer is described. The method including operating a multipole to pass an ion stream, the ion stream comprising an abundance of one or more ion species within stability boundaries defined by (a, q) values and detecting the spatial and temporal properties of the abundance of ions using a detector. The detector formed by a plurality of dynodes, each dynode arranged such that it is struck by ions in a known spatial relationship with the ion stream and a plurality of charged particle detectors are associated with one or more of the plurality of dynodes. The method also storing a pattern of detection of ions in the abundance of ions by the dynodes in the detector.

The foregoing has outlined rather broadly the features and technical advantages of the present disclosure in order that the detailed description that follows may be better understood. Additional features and advantages will be described hereinafter which form the subject of the claims. It should be appreciated by those skilled in the art that the conception and specific embodiment disclosed may be readily utilized as a basis for modifying or designing other structures for carrying out the same purposes. It should also be realized by those skilled in the art that such equivalent constructions do not depart from the spirit and scope of the disclosure as set forth in the appended claims. The novel features which are believed to be characteristic of the disclosed systems and methods, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following descriptions taken in conjunction with the accompanying drawings, in which.

DETAILED DESCRIPTION

Figure 1A:
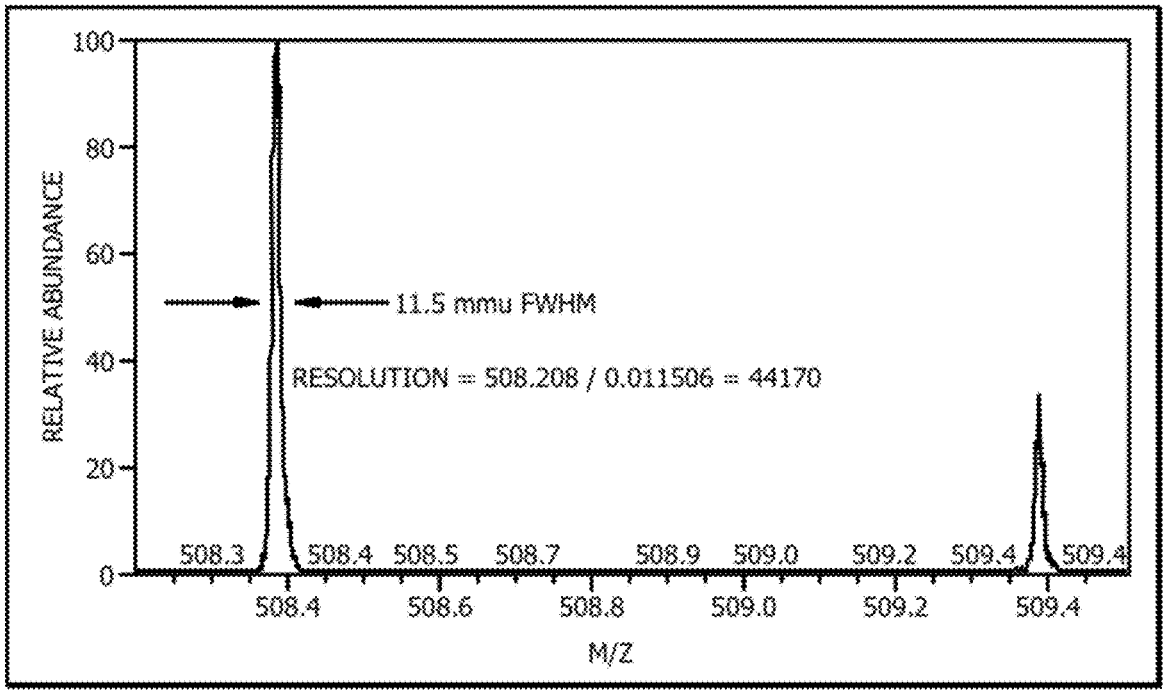
FIG. 1A shows example quadrupole mass data from a TSQ quadrupole mass spectrometer.
Figure 1B:
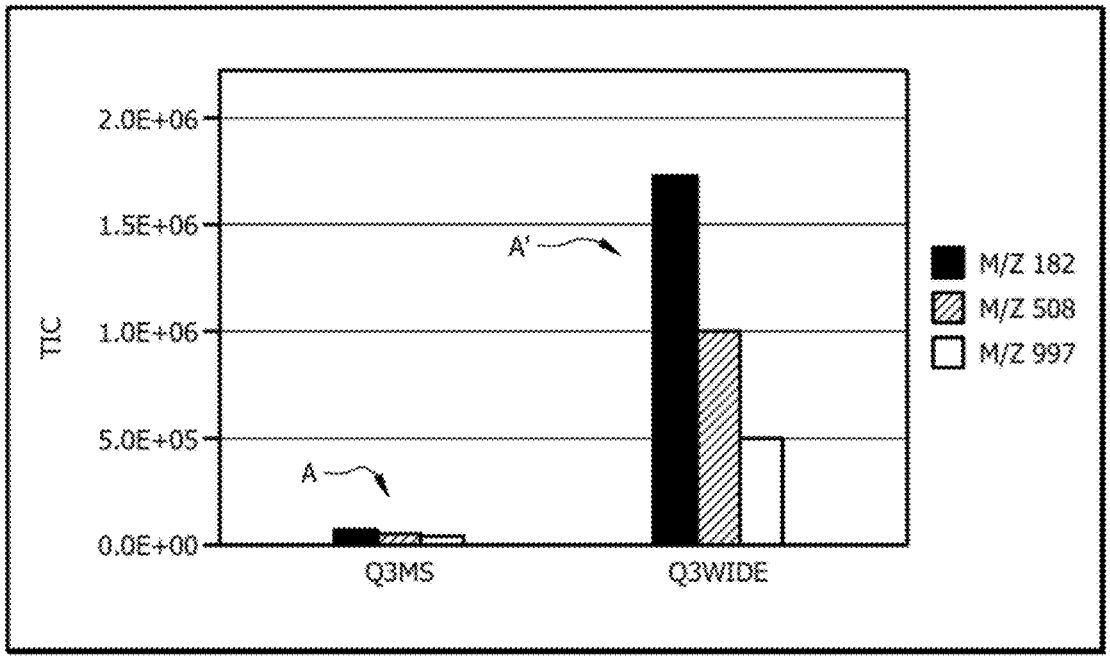
FIG. 1B shows additional Q3 data from a TSQ quadrupole mass spectrometer operated with an AMU stability transmission window of 0.7 FWHM in comparison with an AMU stability transmission window of 10.0 FWHM.

In the description herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the disclosure. Also, reference numerals may be repeated among the various figures to show corresponding or analogous elements. Additionally, it will be understood that any list of such candidates or alternatives is merely illustrative, not limiting, unless implicitly or explicitly understood or stated otherwise. In addition, unless otherwise indicated, numbers expressing quantities of ingredients, constituents, reaction conditions and so forth used in the specification and claims are to be understood as being modified by the term "about."

Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

General Description

Typically, a multipole mass filter (e.g., a quadrupole mass filter) operates on a continuous ion beam although pulsed ion beams may also be used with appropriate modification of the scan function and data acquisition algorithms to properly integrate such discontinuous signals. A quadrupole field is produced within the instrument by dynamically applying electrical potentials on configured parallel rods arranged with four-fold symmetry about a long axis. The axis of symmetry is referred to as the z-axis. By convention, the four rods are described as a pair of x rods and a pair of y rods. At any instant of time, the two x rods have the same potential as each other, as do the two y rods. The potential on the y rods is inverted with respect to the x rods. Relative to the constant potential at the z-axis, the potential on each set of rods can be expressed as a constant DC offset plus an RF component that oscillates rapidly (with a typical frequency of about 1 MHz).

The DC offset on the x-rods is positive so that a positive ion feels a restoring force that tends to keep it near the z-axis; the potential in the x-direction is like a well. Conversely, the DC offset on the y-rods is negative so that a positive ion feels a repulsive force that drives it further away from the z-axis; the potential in the y-direction is like a hill. Together, the x-axis and y-axis potential form a saddle shaped potential well.

An oscillatory RF component is applied to both pairs of rods. The RF phase on the x-rods is the same and differs by 180 degrees from the phase on the y-rods. Ions move inertially along the z-axis from the entrance of the quadrupole to a detector often placed at the exit of the quadrupole. Inside the quadrupole, ions have trajectories that are separable in the x and y directions. In the x-direction, the applied RF field carries ions with the smallest mass-to-charge ratios out of the potential well and into the rods. Ions with sufficiently high mass-to-charge ratios remain trapped in the well and have stable trajectories in the x-direction; the applied field in the x-direction acts as a high-pass mass filter. Conversely, in the y-direction, only the lightest ions are stabilized by the applied RF field, which overcomes the tendency of the applied DC to pull them into the rods. Thus, the applied field in the y-direction acts as a low-pass mass filter. Ions that have both stable component trajectories in both x and y pass through the quadrupole to reach the detector. The DC offset and RF amplitude can be chosen so that only ions with a desired range of m/z values are measured. If the RF and DC voltages are fixed, the ions traverse the quadrupole from the entrance to the exit and exhibit exit patterns that are a periodic function of the containing RF phase. Although where the ions exit is based upon the separable motion in the x and y axis, the observed ion oscillations are completely locked to the RF cycle. As a result of operating a quadrupole in, for example, a mass filter mode, the scanning of the device by providing ramped RF and DC voltages naturally varies the spatial characteristics with time as observed at the exit aperture of the instrument.

The disclosed systems and methods exploit such varying characteristics by collecting the spatially dispersed ions of different m/z even as they exit the quadrupole at essentially the same time. For example, as exemplified in FIG. 2B, at a given instant in time, the ions of mass A and the ions of mass B can lie in two distinct clusters in the exit cross section of the instrument. The disclosed system acquires the dispersed exiting ions with a time resolution on the order of 10 RF cycles, more often down to an RF cycle (e.g., a typical RF cycle of 1 MHz corresponds to a time frame of about 1 microsecond) or with sub RF cycle specificity to provide data in the form of one or more collected images as a function of the RF phase at each RF and/or applied DC voltage. Once collected, the disclosed systems and methods can extract the full mass spectral content in the captured image(s) via a constructed model that deconvolutes the ion exit patterns and thus provide desired ion signal intensities even while in the proximity of interfering signals.

In composition, the quadrupole mass spectrometer of the present disclosure differs from a conventional quadrupole mass-spectrometer in that the disclosed system includes more than one detector for observing ions as they exit the quadrupole, each detector associated with a relative location on the x-axis, y-axis or center of the ion output beam. Conventional quadrupoles merely counts ions without recording the relative positions of the ions. In particular, the disclosed quadrupole can be configured to operate with wide stability limits, while producing high sensitivity. Unlike conventional quadrupole instruments, wider stability limits when utilized herein do not lead to reduced mass resolving power. In fact, the disclosed systems and methods produce high mass resolving power under a wide variety of operating conditions, a property not usually associated with quadrupole mass spectrometers.

Conversely, the quadrupole mass spectrometer of the present disclosure detects spatial information in the exiting ions without using expensive micro channel plates (MCPs) or high-speed photodetectors as are required by Schoen et al. as described above. Instead of detecting the precise impact point on the MCP, preferred embodiments detect the presence of ions in one of five regions. Those regions may include a center region, a region associated with the upper y quadrupole, a region associated with the lower y quadrupole, a region associated with the left x quadrupole and a region associated with the right x quadrupole. For the sake of simplicity, those regions may be referred to as the center (or "c"), y+, y−, x+ and x− regions. In addition to embodiments with five regions, a quadrupole mass spectrometer according to the present disclosure may detect ions in one of three regions, a center region, a y quadrupole region (corresponding to the y+ and y− detectors in a five detector system) and an x quadrupole region (corresponding to the x+ and x− detectors in a five detector system). Other potential embodiments include detectors with any of the following detector combinations: (i) c, x+, x−; (ii) c, y+, y−; (iii) x+, x−, y+, y−; (iv) x+, x−; (v) y+, y−; (vi) c and x y (where x y is equivalent to everything that is not c). Still other configurations with additional or fewer detectors may also be employed based on the application. By looking only for an ion's relative location and not precise location, the system is able to use spatial information while using conventional detector components.

Accordingly, the novel data acquisition and data analysis apparatus and methods disclosed herein simultaneously achieve higher sensitivity and mass resolving power (MRP) at higher scan rates than is possible in conventional systems. Data on both timing and relative spatial detection are gathered. The individual detectors detect the distribution of ion mass-to-charge ratio values that reach the detectors, providing a "mass spectrum", actually a mass-to-charge ratio spectrum.

Specific Description

The trajectory of ions in an ideal quadrupole is modeled by the Mathieu equation. The Mathieu equation describes a field of infinite extent both radially and axially, unlike the real situation in which the rods have a finite length and finite separation. The solutions of the Mathieu equation, as known to those skilled in the art, can be classified as bounded and non-bounded. Bounded solutions correspond to trajectories that never leave a cylinder of finite radius, where the radius depends on the ion's initial conditions. Typically, bounded solutions are equated with trajectories that carry the ion through the quadrupole to the detector. For finite rods, some ions with bounded trajectories hit the rods rather than passing through to the detector, i.e., the bound radius exceeds the radius of the quadrupole orifice. Conversely, some ions with marginally unbounded trajectories pass through the quadrupole to the detector, i.e., the ion reaches the detector before it has a chance to expand radially out to infinity. Despite these shortcomings, the Mathieu equation is still very useful for understanding the behavior of ions in a finite quadrupole.

The Mathieu equation can be expressed in terms of two unitless parameters, a and q. The general solution of the Mathieu equation, i.e., whether or not an ion has a stable trajectory, depends only upon these two parameters. The trajectory for a particular ion also depends on a set of initial conditions—the ion's position and velocity as it enters the quadrupole and the RF phase of the quadrupole at that instant. If m/z denotes the ion's mass-to-charge ratio, U denotes the DC offset, and V denotes the RF amplitude, then a is proportional to U/(m/z) and q is proportional to V/(m/z). The plane of (q, a) values can be partitioned into contiguous regions corresponding to bounded solutions and unbounded solutions. The depiction of the bounded and unbounded regions in the q-a plane is called a stability diagram, as is to be discussed in detail below with respect to FIG. 2A. The region containing bounded solutions of the Mathieu equation is called a stability region. A stability region is formed by the intersection of two regions, corresponding to regions where the x- and y-components of the trajectory are stable respectively. There are multiple stability regions, but conventional instruments involve the principal stability region. The principal stability region has a vertex at the origin of the q-a plane. Its boundary rises monotonically to an apex at a point with approximate coordinates (0.706, 0.237) and falls monotonically to form a third vertex on the a-axis at q approximately 0.908. By convention, only the positive quadrant of the q-a plane is considered. In this quadrant, the stability region resembles a triangle.

Figure 2A:
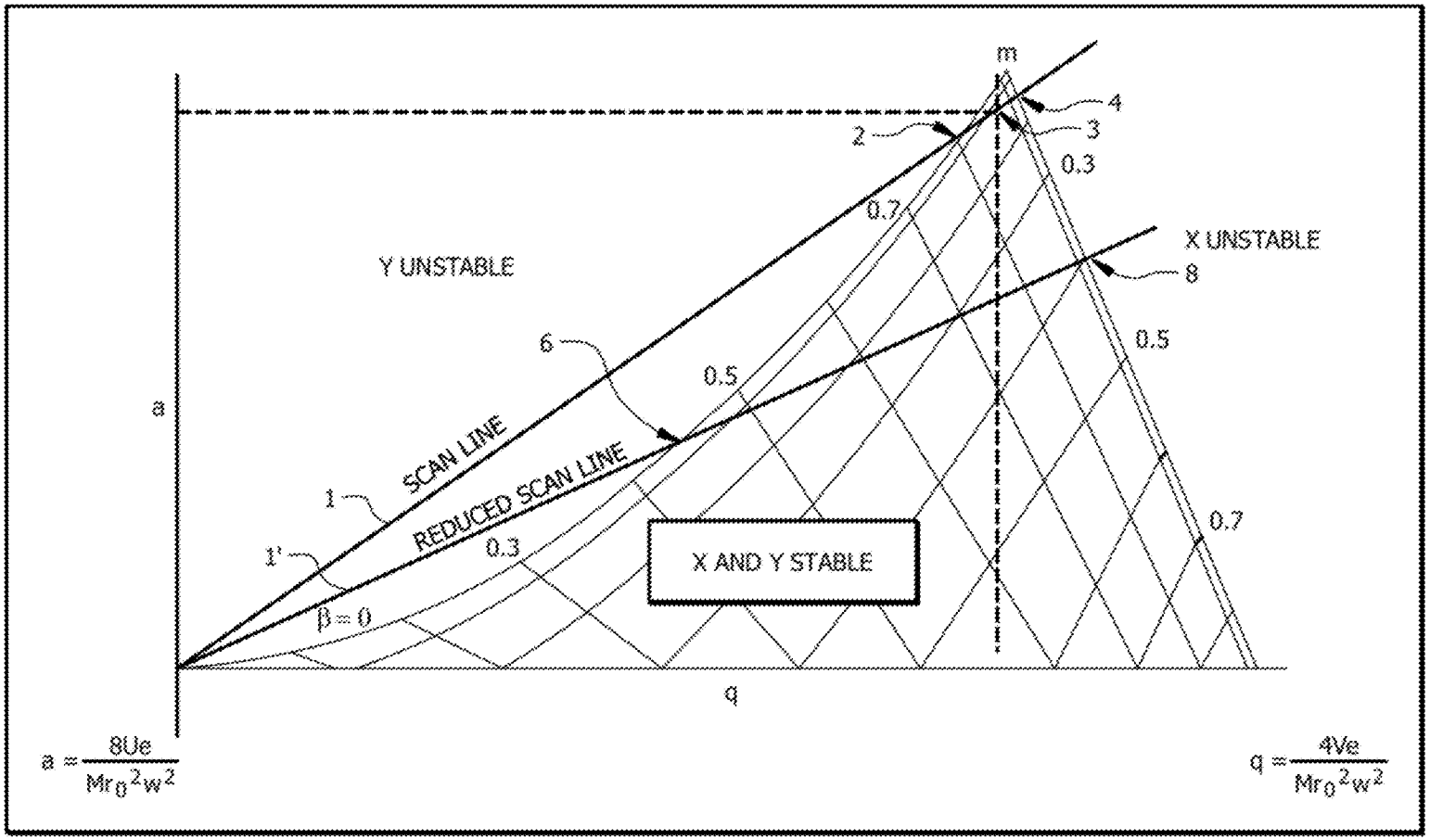
FIG. 2A shows the Mathieu stability diagram with a scan line representing narrower mass stability limits and a "reduced" scan line, in which the DC/RF ratio has been reduced to provide wider mass stability limits.

FIG. 2A shows such an example Mathieu quadrupole stability diagram for ions of a particular mass/charge ratio. For an ion to pass, it must be stable in both the X and Y dimensions simultaneously. The Y iso-beta lines ($\beta_y$), as shown in FIG. 2A, tend toward zero at the tip of the stability diagram and the X iso-beta lines ($\beta_x$) tend toward 1.0. During common operation of a quadrupole for mass filtering purposes, the q and a parameters for corresponding fixed RF and DC values, can be desirably chosen to correspond close to the apex (denoted by m) in the diagram "parked" so that substantially only m ions can be transmitted and detected. For other values of U/V ratios, ions with different m/z values map onto a line in the stability diagram passing through the origin and a second point (q*,a*) (denoted by the reference character 2). The set of values, called the operating line, as denoted by the reference character 1 shown in FIG. 2A, can be denoted by {(kq*, ka*): k>0), with k inversely proportional to m/z. The slope of the line is specified by the U/V ratio. When q and a and thus proportionally applied RF and DC voltages to a quadrupole are increased at a constant ratio, the scan line 1 is configured to pass through a given stability region for an ion.

Therefore, the instrument, using the stability diagram as a guide can be "parked", i.e., operated with a fixed U and V to target a particular ion of interest, (e.g., at the apex of FIG. 2A as denoted by m) or "scanned", increasing both U and V amplitude monotonically to bring the entire range of m/z values into the stability region at successive time intervals, from low m/z to high m/z. A special case is when U and V are each ramped linearly in time. In this case, all ions progress the same fixed operating line through the stability diagram, with ions moving along the line at a rate inversely proportional to m/z. For example, if an ion of mass-to-charge ratio M passes through (q*,a*) 2 at time t, an ion with mass-to-charge 2M passes through the same point at time 2t. If (q*,a*) 2 is placed just below the tip of the stability diagram of FIG. 2A, so that mass-to-charge M is targeted at time t, then mass-to-charge ratio 2M is targeted at time 2t. Therefore, the time scale and m/z scale are linearly related. As a result, the flux of ions hitting the detector as a function of time is very nearly proportional to the mass distribution of ions in a beam. That is, the detected signal is a "mass spectrum".

To provide increased sensitivity by increasing the abundance of ions reaching the detector, the scan line 1', as shown in FIG. 2A, can be reconfigured with a reduced slope, as bounded by the regions 6 and 8. When the RF and DC voltages are ramped linearly with time, ("scanned" as stated above) every m/z value follows the same path in the Mathieu stability diagram (i.e., the q, a path) with the ions, as before, moving along the line at a rate inversely proportional to m/z.

To further appreciate ion movement with respect to the Mathieu stability diagram, it is known that an ion is unstable in the y-direction before entering the stability region but as the ion enters a first boundary 2 of the stability diagram (having a $\beta_y$=0), it becomes critically stable, with relatively large oscillations of high amplitude and low frequency in the y-direction that tend to decrease over time. As the ion exits the stability diagram as shown by the boundary region 4, it becomes unstable in the x-direction ($\beta_x$=1), and so the oscillations in the x-direction tend to increase over time, with relatively large oscillations in x just before exiting. If the scan line is operated in either the y-unstable region or the x-unstable region, ions not bounded within the stability diagram discharge against the electrodes and are not detected. Generally, if two ions are stable at the same time, the heavier one (entering the stability diagram later) has larger y-oscillations and the lighter one has larger x-oscillations.

The other aspect of ion motion that changes as the ion moves through the stability region of FIG. 2A is the frequency of oscillations in the x- and y-directions (as characterized by the Mathieu parameter beta (β)). As the ion enters the stability diagram, the frequency of its (fundamental) oscillation in the y-direction is essentially zero and rises to some exit value. The fundamental y-direction ion frequency increases like a "chirp", i.e., having a frequency increasing slightly non-linearly with time as beta increases non-linearly with the a:q ramp, as is well known in the art. Similarly, the frequency (ω) of the fundamental x-direction oscillation also increases from some initial value slightly below the RF/2 or (ω/2) up to exactly the ω/2 (β=1) at the exit. It is to be appreciated that the ion's motion in the x-direction is dominated by the sum of two different oscillations with frequencies just above and below the main (ω/2). The one just below ω/2 (i.e., the fundamental) is the mirror image of the one just above ω/2. The two frequencies meet just as the ion exits, which results in a very low frequency beating phenomenon just before the ion exits, analogous to the low frequency y-oscillations as the ion enters the stability region.

Thus, if two ions are stable at the same time, the heavier one (not as far through the stability diagram) has slower oscillations in both X and Y (slightly in X, but significantly so in Y); with the lighter one having faster oscillations and has low-frequency beats in the X-direction if it is near the exit. The frequencies and amplitudes of micromotions also change in related ways that are not easy to summarize concisely, but also help to provide mass discrimination. This complex pattern of motion is utilized in a novel fashion to distinguish two ions with very similar mass.

As a general statement of the above description, ions manipulated by a quadrupole are induced to perform an oscillatory motion "an ion dance" on the detector cross section as it passes through the stability region. Every ion does exactly the same dance, at the same "a" and "q" values, just at different RF and DC voltages at different times. The ion motion (i.e., for a cloud of ions of the same m/z but with various initial displacements and velocities) is completely characterized by a and q by influencing the position and shape cloud of ions exiting the quadrupole as a function of time. For two masses that are almost identical, the speed of their respective dances is essentially the same and can be approximately related by a time shift.

Figure 2B:
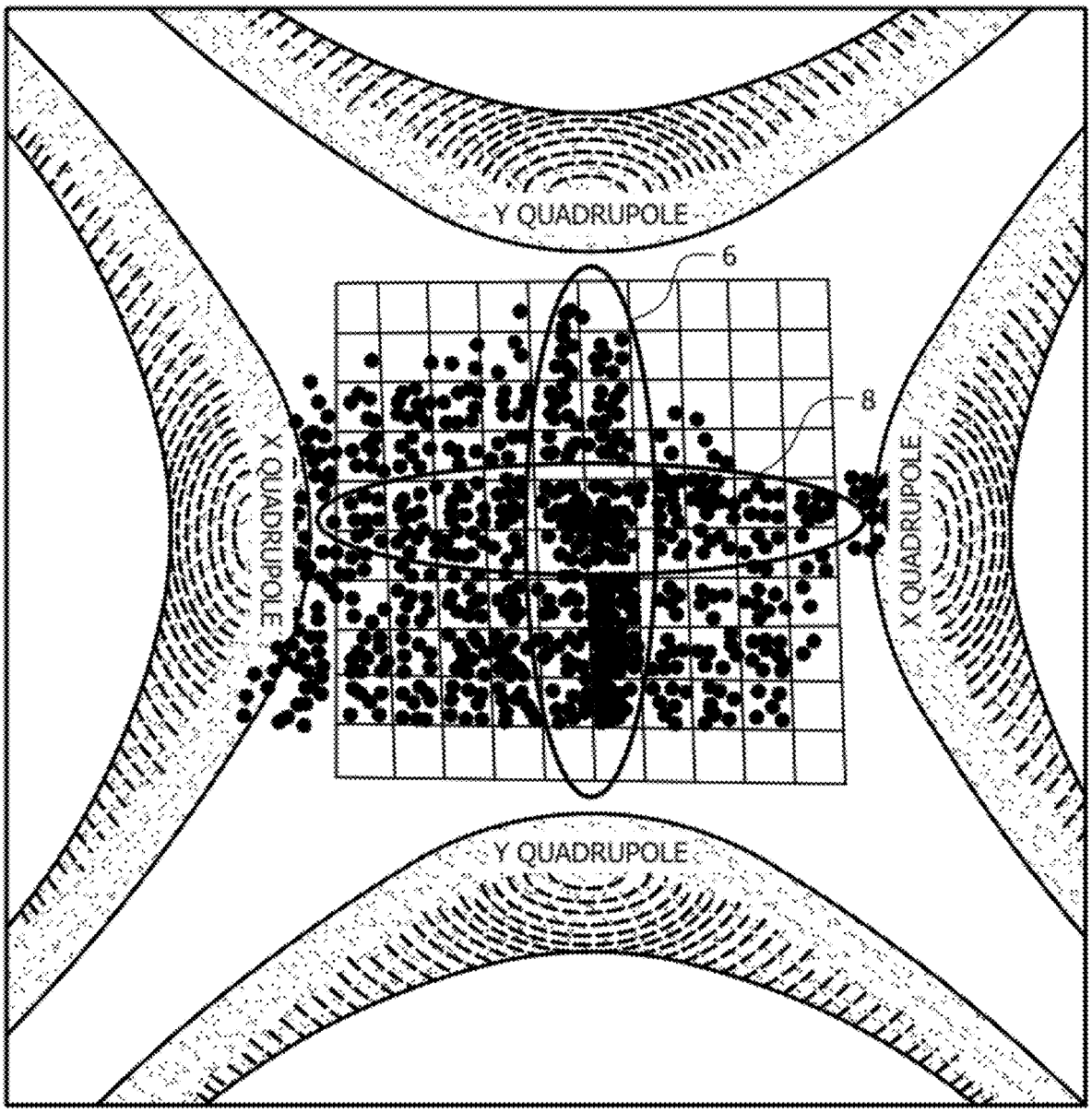
FIG. 2B shows a simulated recorded image of a multiple distinct species of ions as collected at the exit aperture of a quadrupole at a particular instant in time.

FIG. 2B shows a simulated recorded image of a particular pattern at a particular instant in time of such an "ion dance". The example image can be collected by a fast detector, (i.e., a detector capable of time resolution of 10 RF cycles, more often down to an RF cycle or with sub RF cycles specificity) as discussed herein, positioned to acquire where and when ions exit and with substantial mass resolving power to distinguish fine detail. As stated above, when an ion, at its (q, a) position, enters the stability region during a scan, the y-component of its trajectory changes from "unstable" to "stable". Watching an ion image formed in the exit cross section progress in time, the ion cloud is elongated and undergoes wild vertical oscillations that carry it beyond the top and bottom of a collected image. Gradually, the exit cloud contracts, and the amplitude of the y-component oscillations decreases. If the cloud is sufficiently compact upon entering the quadrupole, the entire cloud remains in the image, i.e. 100% transmission efficiency, during the complete oscillation cycle when the ion is well within the stability region.

As the ion approaches the exit of the stability region, a similar effect happens, but in reverse and involving the x-component rather than y. The cloud gradually elongates in the horizontal direction and the oscillations in this direction increase in magnitude until the cloud is carried across the left and right boundaries of the image. Eventually, both the oscillations and the length of the cloud increase until the transmission decreases to zero.

FIG. 2B graphically illustrates such a result. Specifically, FIG. 2B shows five masses (two shown highlighted graphically within ellipses) with stable trajectories through the quadrupole. However, at the same RF and DC voltages, each comprises a different a and q and therefore 'beta' so at every instant, a different exit pattern.

In particular, the vertical cloud of ions, as enclosed graphically by the ellipse 6 shown in FIG. 2B, correspond to the heavier ions entering the stability diagram, as described above, and accordingly oscillate with an amplitude that brings such heavy ions close to the denoted Y quadrupoles. The cluster of ions enclosed graphically by the ellipse 8 shown in FIG. 2B correspond to lighter ions exiting the stability diagram, as also described above, and thus cause such ions to oscillate with an amplitude that brings such lighter ions close to the denoted X quadrupoles. Within the image lie the additional clusters of ions (shown in FIG. 2B but not specifically highlighted) that have been collected at the same time frame but which have a different exit pattern because of the differences of their a and q and thus 'beta' parameters.

Every exit cloud of ions thus performs the same "dance", oscillating wildly in y as it enters the stability region and appears in the image, settling down, and then oscillating wildly in x as it exits the stability diagram and disappears from the image. Even though all ions do the same dance, the timing and the tempo vary. The time when each ion begins its dance, i.e. enters the stability region, and the rate of the dance, are scaled by $(m/z)^{-1}$.

As can be seen from FIG. 2B, the majority of spatial information is contained in the ion's location along the x-axis or y-axis when it hits the detector. By placing determining if an ion hit the center, y+, y−, x+ or x− detector, information about that ion can be deduced. Heavier ions will primarily enter the y+ and y− detectors while lighter ions will primarily enter the x+ and x− detectors. Ions with intermediate mass will not have large oscillations in either direction and will therefore primarily enter the center detector.

A key point is that merely classifying ion trajectories as bounded versus unbounded does not harness the full potential of a quadrupole to distinguish ions with similar mass-to-charge ratios. Finer distinctions can be made among ions with bounded trajectories by recording which detector the ions enter as a function of the applied fields. The disclosure demonstrates the ability to distinguish the m/z values of ions that are simultaneously stable in the quadrupole by recording the times and relative detectors. Leveraging this ability can have a profound impact upon the sensitivity of a quadrupole mass spectrometer. Because only ions with bounded trajectories are measured, it necessarily follows that the signal-to-noise characteristic of any ion species improves with the number of ions that actually reach the detector.

The stability transmission window for the quadrupole of the present disclosure can thus be configured in a predetermined manner (i.e., by reducing the slope of the scan line 1', as shown in FIG. 2A) to allow a relatively broad range of ions to pass through the instrument, the result of which increases the signal-to-noise because the number of ions recorded for a given species is increased. Accordingly, by increasing the number of ions, a gain in sensitivity is beneficially provided because at a given instant of time a larger fraction of a given species of ions can now not only pass through the quadrupole but also pass through the quadrupole for a much longer duration of the scan. The potential gain in sensitivity necessarily follows by the multiplicative product of these factors.

However, while the increase in ion counts is necessary, there are certain tradeoffs that may be required for increased sensitivity. As an example, when a quadrupole is operated as a mass-filter with improved ion statistics, i.e., by opening the transmission stability window, a gain in sensitivity can be negated by a loss in mass resolving power because the low-abundance species within the window may be obscured by one of higher abundance that is exiting the quadrupole in the same time frame. To mitigate such an effect, it is to be appreciated that while the mass resolving power is potentially substantially large (i.e., by operating with RF-only mode), often the system is operated with a mass resolving power window of up to about 10 AMU wide and in some applications, up to about 20 AMU in width in combination with scan rates necessary to provide for useful signal to noise ratios within the chosen m/z transmission window.

Using spatial information as a basis for separation enables the disclosed methods and instruments to provide not only high sensitivity, (i.e., an increased sensitivity 10 to 200 times greater than a conventional quadrupole filter) but to also simultaneously provide for differentiation of mass deltas of 1,000 ppm (a mass resolving power of one thousand) down to about 10 ppm (a mass resolving power of 100 thousand). Unexpectedly, the disclosed systems and methods can even provide for an unparalleled mass delta differentiation of 1 ppm (i.e., a mass resolving power of 1 million) if the devices disclosed herein are operated under ideal conditions that include minimal drift of all electronics.

Figure 3:
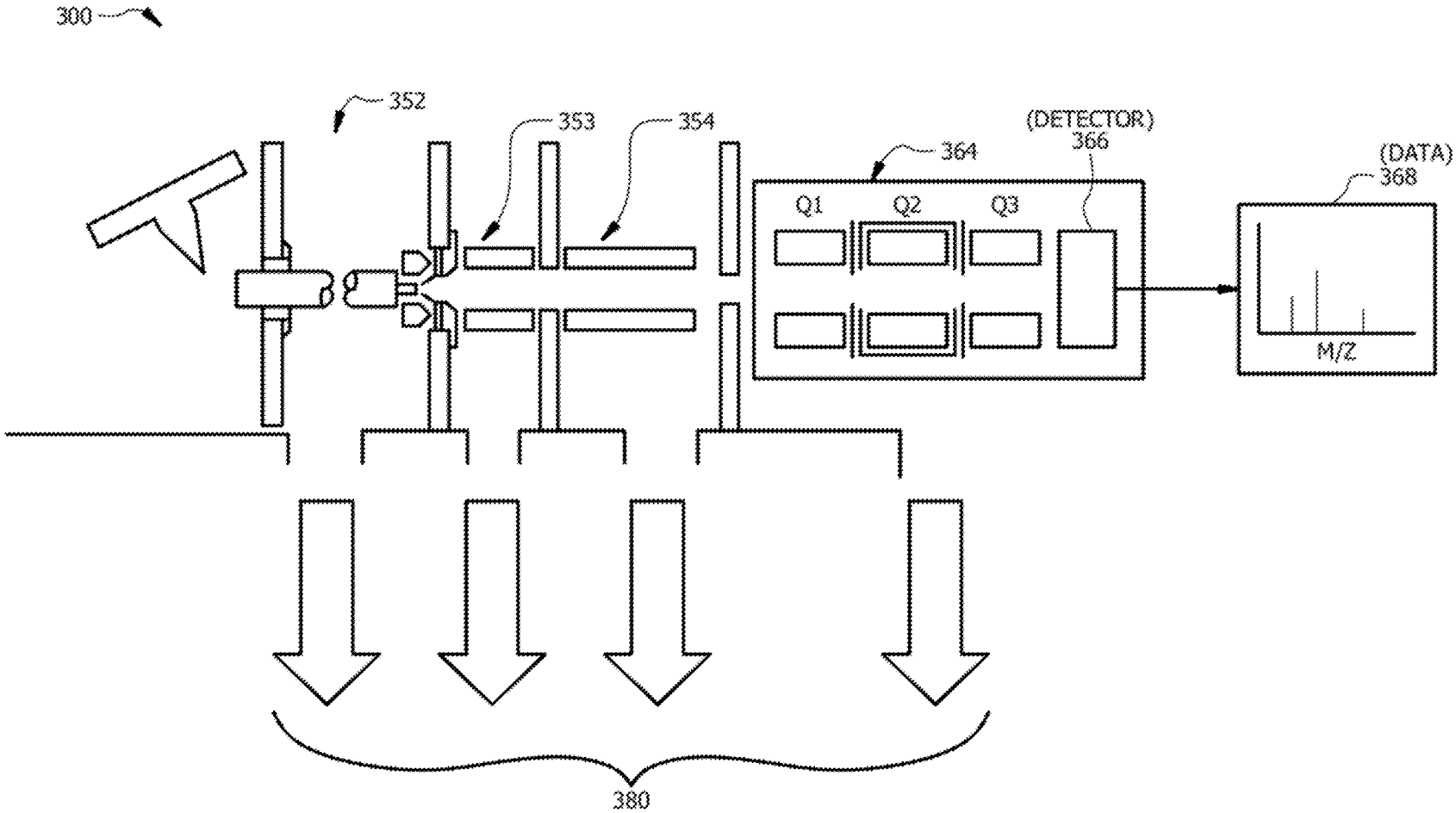
FIG. 3 shows a beneficial example configuration of a triple stage mass spectrometer system that can be operated with the disclosed methods.

Referring now to FIG. 3, a beneficial example configuration of a triple stage mass spectrometer system (e.g., a commercial TSQ mass spectrometer) is shown generally designated by the reference numeral 300. It is to be appreciated that mass spectrometer system 300 is presented by way of a non-limiting beneficial example and thus the disclosed methods may also be practiced in connection with other mass spectrometer systems having architectures and configurations different from those depicted herein.

The operation of mass spectrometer 300 can be controlled and data can be acquired by a control and data system (not depicted) of various circuitry of a known type, which may be implemented as any one or a combination of general or special-purpose processors (digital signal processor (DSP)), firmware, software to provide instrument control and data analysis for mass spectrometers and/or related instruments, and hardware circuitry configured to execute a set of instructions that embody the prescribed data analysis and control routines. Such processing of the data may also include averaging, scan grouping, deconvolution as disclosed herein, library searches, data storage, and data reporting.

It is also to be appreciated that instructions to start predetermined slower or faster scans as disclosed herein, the identifying of a set of m/z values within the raw file from a corresponding scan, the merging of data, the exporting/displaying/outputting to a user of results, etc., may be executed via a data processing based system (e.g., a controller, a computer, a personal computer, etc.), which includes hardware and software logic for performing the aforementioned instructions and control functions of the mass spectrometer 300.

In addition, such instruction and control functions, as described above, can also be implemented by a mass spectrometer system 300, as shown in FIG. 3, as provided by a machine-readable medium (e.g., a computer readable medium). A computer-readable medium, in accordance with aspects of the present disclosure, refers to mediums known and understood by those of ordinary skill in the art, which have encoded information provided in a form that can be read (i.e., scanned/sensed) by a machine/computer and interpreted by the machine's/computer's hardware and/or software.

Thus, as mass spectral data of a given spectrum is received by a beneficial mass spectrometer 300 system disclosed herein, the information embedded in a computer program can be utilized, for example, to extract data from the mass spectral data, which corresponds to a selected set of mass-to-charge ratios. In addition, the information embedded in a computer program can be utilized to carry out methods for normalizing, shifting data, or extracting unwanted data from a raw file in a manner that is understood and desired by those of ordinary skill in the art.

Turning back to the example mass spectrometer 300 system of FIG. 3, a sample containing one or more analytes of interest can be ionized via an ion source 352. A multipole can be operated either in the radio frequency (RF)-only mode or an RF/DC mode. Depending upon the particular applied RF and DC potentials, only ions of selected charge to mass ratios are allowed to pass through such structures with the remaining ions following unstable trajectories leading to escape from the applied multipole field. When only an RF voltage is applied between predetermined electrodes (e.g., spherical, hyperbolic, flat electrode pairs, etc.), the apparatus is operated to transmit ions in a wide-open fashion above some threshold mass. When a combination of RF and DC voltages is applied between predetermined rod pairs there is both an upper cutoff mass as well as a lower cutoff mass. As the ratio of DC to RF voltage increases, the transmission band of ion masses narrows so as to provide for mass filter operation, as known and as understood by those skilled in the art.

Accordingly, the RF and DC voltages applied to predetermined opposing electrodes of the multipole devices, as shown in FIG. 3 (e.g., Q3), can be applied in a manner to provide for a predetermined stability transmission window designed to enable a larger transmission of ions to be directed through the instrument, collected at the exit aperture and processed so as to determined mass characteristics.

An example multipole, e.g., Q3 of FIG. 3, can thus be configured along with the collaborative components of a system 300 to provide a mass resolving power of potentially up to about 1 million with a quantitative increase of sensitivity of up to about 200 times as opposed to when utilizing typical quadrupole scanning techniques. In particular, the RF and DC voltages of such devices can be scanned over time to interrogate stability transmission windows over predetermined m/z values (e.g., 20 AMU). Thereafter, the ions having a stable trajectory reach a detector 366 capable of time resolution on the order of 10 RF cycles, or 1RF cycle, or multiple times per RF cycle at a pressure as defined by the system requirements. Accordingly, the ion source 352 can include, but is not strictly limited to, an Electron Ionization (EI) source, a Chemical Ionization (CI) source, a photoionization source, a Matrix-Assisted Laser Desorption Ionization (MALDI) source, an Electrospray Ionization (ESI) source, an Atmospheric Pressure Chemical Ionization (APCI) source, an atmospheric pressure photoionization (APPI) source, a Nanoelectrospray Ionization (NanoESI) source, and an Atmospheric Pressure Ionization (API) source, etc.

The resultant ions are directed via predetermined ion optics that often can include tube lenses, skimmers, and multipoles, e.g., reference characters 353 and 354, selected from radio-frequency RF quadrupole and octopole ion guides, etc., so as to be urged through a series of chambers of progressively reduced pressure that operationally guide and focus such ions to provide good transmission efficiencies. The various chambers communicate with corresponding ports 380 (represented as arrows in the figure) that are coupled to a set of pumps (not shown) to maintain the pressures at the desired values.

The example spectrometer 300 of FIG. 3 is shown illustrated to include a triple stage configuration 364 having sections labeled Q1, Q2 and Q3 electrically coupled to respective power supplies (not shown) so as to perform as a quadrupole ion guide that can also be operated under the presence of higher order multipole fields (e.g., an octopole field) as known to those of ordinary skill in the art. It is to be noted that such pole structures of the present more, more often down to an RF cycle or with sub RF cycles specificity, wherein the specificity is chosen to provide appropriate resolution relative to the scan rate to provide desired mass differentiation. Such a detector is beneficially placed at the channel exit of the quadrupole (e.g., Q3 of FIG. 3) to provide data that can be deconvoluted into a rich mass spectrum 368. The resulting time-dependent data resulting from such an operation is converted into a mass spectrum by applying deconvolution methods described herein that convert the collection of recorded ion arrival times and positions into a set of m/z values and relative abundances.

A simplistic configuration to observe such varying characteristics with time can be in the form of a narrow means (e.g., a pinhole) spatially configured along a plane between the exit aperture of the quadrupole (Q3) and a respective detector 366 designed to record the allowed ion information. By way of such an arrangement, the time-dependent ion current passing through the narrow aperture provides for a sample of the envelope at a given position in the beam cross section as a function of the ramped voltages. Importantly, because the envelope for a given m/z value and ramp voltage is approximately the same as an envelope for a slightly different m/z value and a shifted ramp voltage, the time-dependent ion currents passing through such an example narrow aperture for two ions with slightly different m/z values are also related by a time shift, corresponding to the shift in the RF and DC voltages. The appearance of ions in the exit cross section of the quadrupole depends upon time because the RF and DC fields depend upon time. In particular, because the RF and DC fields are controlled by the user, and therefore known, the time-series of ion images can be beneficially modeled using the solution of the well-known Mathieu equation for an ion of arbitrary m/z.

However, while the utilization of a narrow aperture at a predetermined exit spatial position of a quadrupole device illustrates the basic idea, there are in effect multiple narrow aperture positions at a predetermined spatial plane at the exit aperture of a quadrupole as correlated with time, each with different detail and signal intensity. To beneficially record such information, the spatial/temporal detector 366 configurations are in effect somewhat of a multiple pinhole array that essentially provides multiple channels of resolution to spatially record the individual shifting patterns as images that have the embedded mass content. The applied DC voltage and RF amplitude can be stepped synchronously with the RF phase to provide measurements of the ion images for arbitrary field conditions. The applied fields determine the appearance of the image for an arbitrary ion (dependent upon its m/z value) in a way that is predictable and deterministic. By changing the applied fields, the disclosed systems and methods can obtain information about the entire mass range of the sample.

As a side note, there are field components that can disturb the initial ion density as a function of position in the cross section at a configured quadrupole opening as well as the ions' initial velocity if left unchecked. For example, the field termination at an instrument's entrance, e.g., Q3's, often includes an axial field component that depends upon ion injection. As ions enter, the RF phase at which they enter effects the initial displacement of the entrance phase space, or of the ion's initial conditions. Because the kinetic energy and mass of the ion determines its velocity and therefore the time the ion resides in the quadrupole, this resultant time determines the shift between the ion's initial and exit RF phase. Thus, a small change in the energy alters this relationship and therefore the exit image as a function of overall RF phase. Moreover, there is an axial component to the exit field that also can perturb the image. While somewhat deleterious if left unchecked, the disclosed systems and methods can be configured to mitigate such components by, for example, cooling the ions in a multipole, e.g., the collision cell Q2 shown in FIG. 3, and injecting them on axis or preferably slightly off-center by phase modulating the ions within the device. The direct observation of a reference signal, i.e. a time series of images, rather than direct solution of the Mathieu equation, allows us to account for a variety of non-idealities in the field. The Mathieu equation can be used to convert a reference signal for a known m/z value into a family of reference signals for a range of m/z values. This technique provides the method with tolerance to non-idealities in the applied field.

The Effect of Ramp Speed

As discussed above, as the RF and DC amplitudes are ramped linearly in time, the a, q values for each ion each increase linearly with time, as shown above in FIG. 2A. Alternatively, the RF and DC amplitudes can be ramped exponentially with mass, such that the scan rate is proportional to the mass. Specifically, the ions in traversing the length of a quadrupole undergo a number of RF cycles during this changing condition and as a consequence, such ions experience a changing beta during the ramping of the applied voltages. Accordingly, the exit position for the ions after a period of time change as a function of the ramp speed in addition to other aforementioned factors. Moreover, in a conventional selective mass filter operation, the peak shape is negatively affected by ramp speed because the filter's window at unit mass resolving power shrinks substantially and the high and low mass cutoffs become smeared. A user of a conventional quadrupole system in wanting to provide selective scanning (e.g., unit mass resolving power) of a particular desired mass often configures his or her system with chosen a:q parameters and then scans at a predetermined discrete rate, e.g., a scan rate at about 500 (AMU/sec) to detect the signals.

However, while such a scan rate and even slower scan rates can also be utilized herein to increase desired signal to noise ratios, the disclosed systems and methods can also optionally increase the scan velocity up to about 10,000 AMU/sec and even up to about 100,000 AMU/sec as an upper limit because of the wider stability transmission windows and thus the broader range of ions that enable an increased quantitative sensitivity. Benefits of increased scan velocities include decreased measurement time frames, as well as operating the disclosed system in cooperation with survey scans, wherein the a:q points can be selected to extract additional information from only those regions (i.e., a target scan) where the signal exists so as to also increase the overall speed of operation.

The Detector

Figure 4:
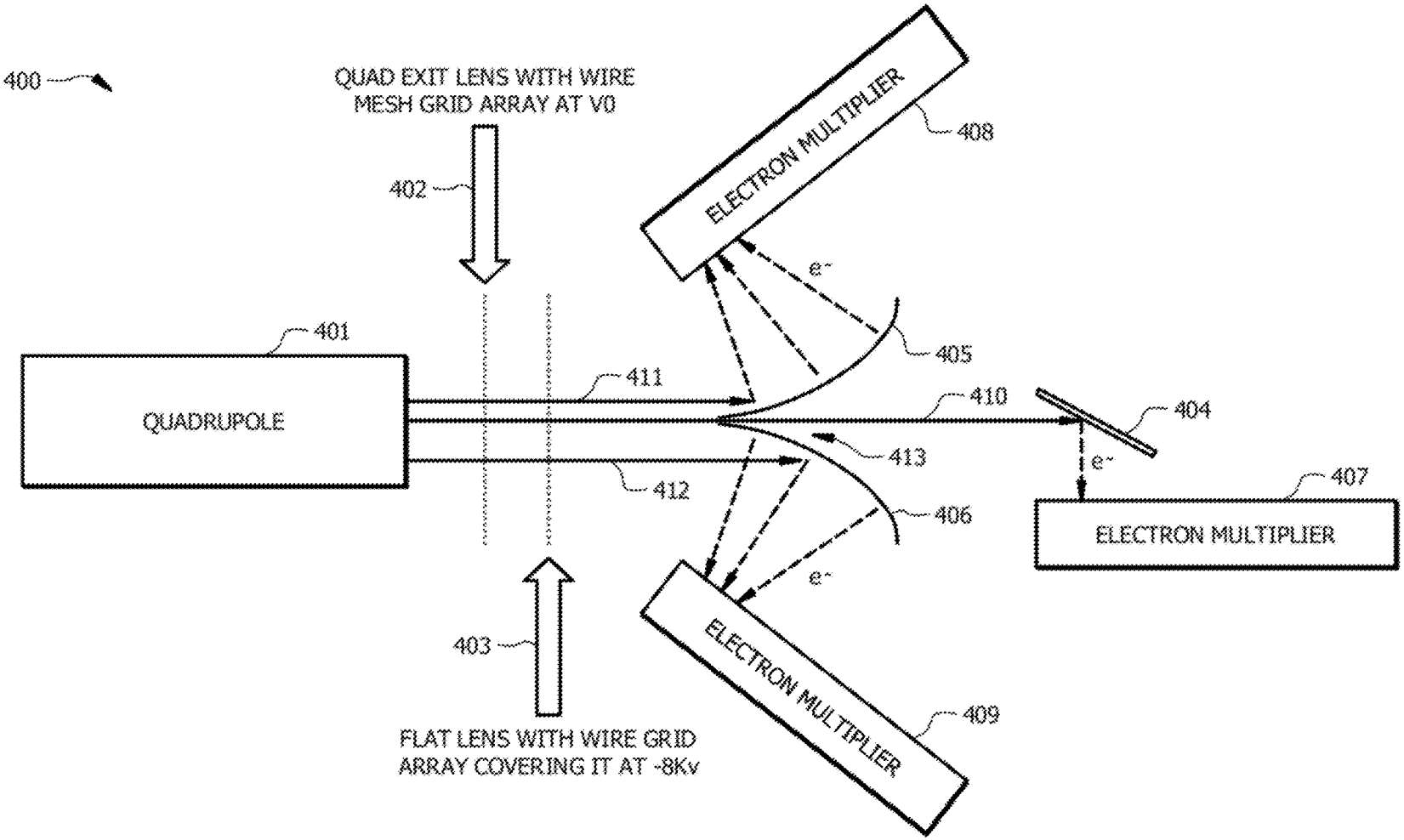
FIG. 4 shows an example embodiment of an ion detector system employing multiple spatial detectors.

FIG. 4 shows a basic non-limiting beneficial example embodiment of a spatial ion detector system according to the concepts described herein. The spatial ion detector system designated by the reference numeral 400 detects both the presence of and the relative spatial orientation of incoming ions from a quadrupole 401. As shown in FIG. 4, incoming ions 410, 411 and 412 (shown directionally by way of accompanying arrows) pass through a quadrupole exit lens 402 and a flat lens 403. The ions are then received by a particular dynode in an assembly of dynodes 404, 405 and 406. Each dynode is simply an electrode that emits a secondary particle, such as electrons, protons, or positive ions, when an ion with sufficient kinetic energy slams into it. Such an assembly can consist of any number of dynodes sufficient to capture the spatial information of interest, but in preferred embodiments is five dynodes associated with a central, y+, y−, x+ and x-spatial region. FIG. 4 illustrates the y+ dynode 405, the y− dynode 406 and the center dynode 404. The x+ and x− dynodes would be in the plane perpendicular to the y+ and y− dynodes. When an ion strikes a dynode, a secondary particle, such as an electron e, a proton, or a positive ion, is generated that travels in path that the ion would have traveled. Each dynode may be associated with a charged particle detector 407, 408 and 409 that receives the secondary particle emitted from a particular dynode and acts to amplify the signal for easier processing. In various embodiments, the charged particle detector can be an electron multiplier, a photomultiplier, a silicon photomultiplier, an avalanche photodiode, another type of secondary particle detector, or any combination thereof.

FIG. 4 shows streams of ions 410, 411 and 412 emitted by quadrupole 401. Each of the streams of ions has a relative spatial location within the overall stream. Stream 410 is in the center of the ion beam and passes through aperture 413 in the dynode assembly. After passing through aperture 413 stream 410 strikes dynode 404, which emits a secondary particle that then strikes charged particle detector 407. Similarly, streams 411 and 412 are respectively above (y+) and below (y−) the center, and therefore strike dynode 405 and 406. Ions striking dynode 405 generate a secondary particle that then hits charged particle detector 408, while ions striking dynode 406 generate a secondary particle that hits charged particle detector 409. In this manner, both information on the timing of the ions and their relative spatial orientation can be collected.

Figure 5:
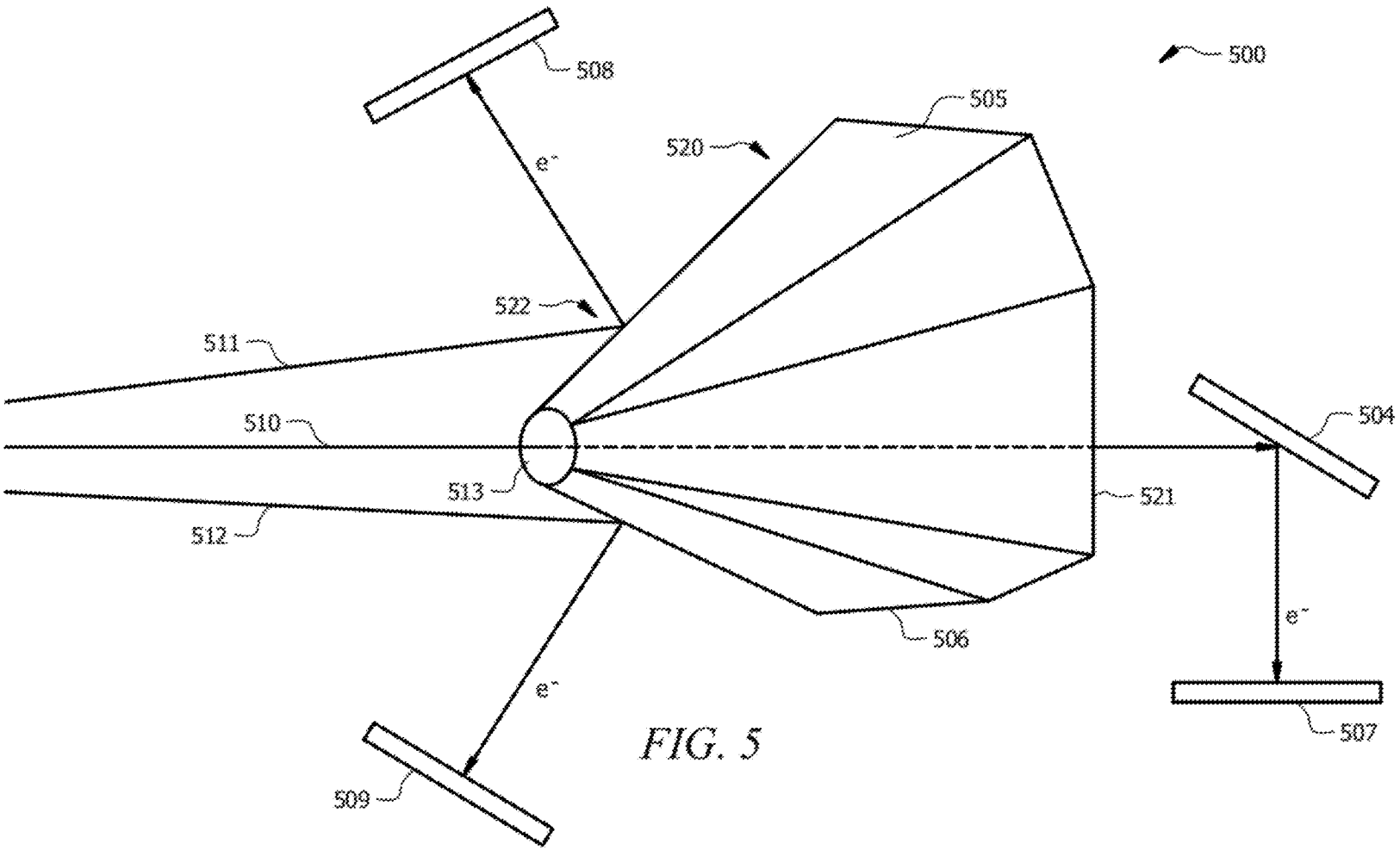
FIG. 5 shows an example embodiment of a dynode for use in the disclosed ion detector system.

FIG. 5 shows a basic non-limiting beneficial example embodiment of a dynode assembly according to the concepts described herein. Dynode assembly 500 includes central dynode 504 and dynode structure 520 which is formed by y+ dynode 505, y− dynode 506, x+ dynode 521 and x− dynode 522 on the surface opposite x+ dynode 521. As described with reference to FIG. 4, dynode assembly 500 acts to separate an incoming ion beam into its spatial components with central ion stream 510 passing through aperture 513 of dynode structure 520 to strike dynode 504 which sends a secondary particle, such as electron $e^-$, to charged particle detector 507. Similarly, ions "above" the center of the ion stream, as shown by ion stream 511 strike the y+ dynode 505 and cause a secondary particle to strike charged particle detector 508, while ions "below" the center of the ion stream 512 strike the y− dynode 506 and cause a secondary particle to strike charged particle detector 509. Though not shown, the same is true for ions to the "right" of the center of the ion stream and to the "left" of the center, which strike the x+ dynode 521 and x− dynode 522, respectively.

In certain embodiments, it might not be important to distinguish between the y+ and y− ions and the x+ and x− ions. In such cases, an embodiment of the dynode assembly might use three charged particle detectors instead of five and direct secondary particles from both the y+ dynode and the y− dynode to a single charged particle detector and secondary particles from the x+ dynode and x− dynode to a single charged particle detector.

Figure 6B:
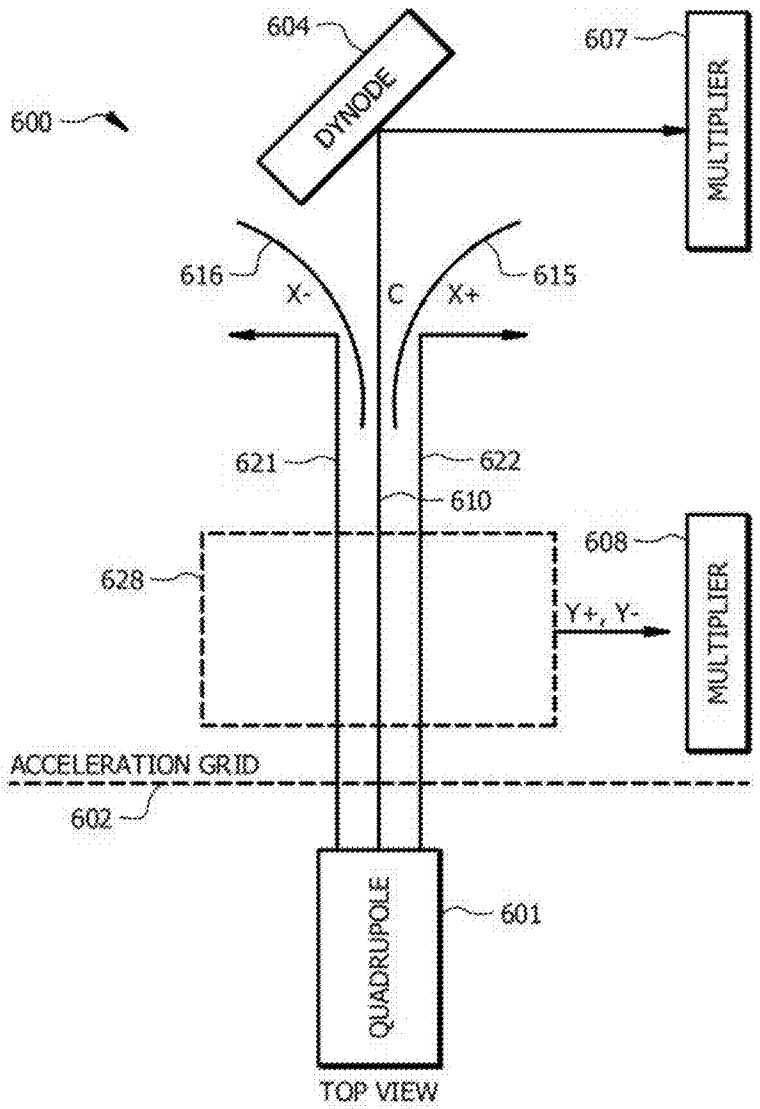
FIGS. 6A and 6B show top and side views respectively of an example of an ion detector system employing three spatial detectors.
Figure 6A:
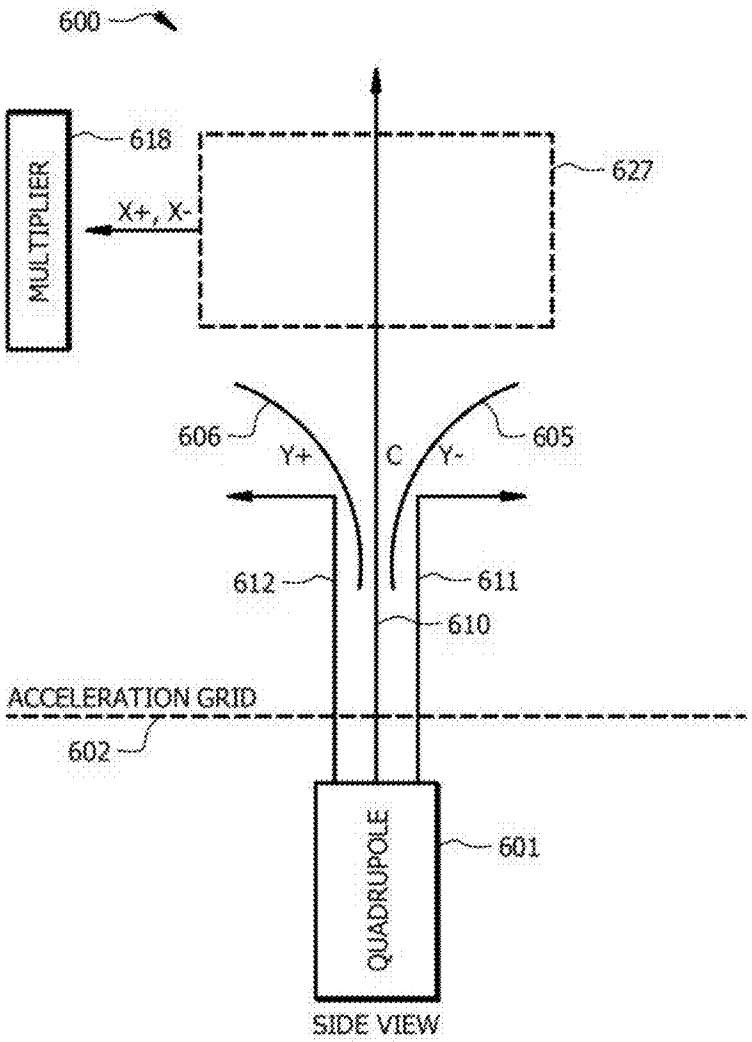

FIGS. 6A and 6B shows a basic non-limiting beneficial example embodiment of a dynode assembly according to the concepts described herein. FIG. 6A is a side view that shows the ions 610, 611 and 612 while FIG. 6B is a top view of the same assembly showing ions 610, 621 and 622. The dynode assembly uses 3 charged particle detectors to detect a center stream c, a combined x+ and x− stream, and a combined y+ and y− stream. As with the detector assembly described in FIG. 4, the spatial ion detector system designated by the reference numeral 600 detects both the presence of and the relative spatial orientation of incoming ions from a quadrupole 601, except that no differentiation is made between the x+ and x− ions or the y+ and y− ions. Incoming ions 610, 611 and 612 pass through acceleration grid 602. The ions are then received by a particular dynode in an assembly of dynodes 604, 605, 606, 615 and 616. Side view, FIG. 6A illustrates the y− dynode 605, the y+ dynode 606 and the center dynode 604 while top view, FIG. 6B illustrates the x+ 615 and x− 616 dynodes in the plane perpendicular to the y+ and y− dynodes. When an ion strikes a dynode a secondary particle is generated that travels in path that the ion would have traveled. Each dynode may be associated with an charged particle detector 607, 608 and 618 that receives the secondary particles emitted from a particular dynode and acts to amplify the signal for easier processing.

In contrast with FIG. 5, where the x axis and y axis dynodes where part of the same assembly, the dynode assembly of FIGS. 6A and 6B. spatially separates the x axis and y axis dynodes. This separation allows y+ and y− to be combined in combining elements 628 into y+,y− and sent to charged particle detector 608 while x+ and x− pass spatially by combining element 628 and are then redirected and combined in combining elements 627 and then detected at charged particle detector 618. Center ion stream 610 passes through both sets of combining elements 627 and 628 and is detected by charged particle detector 607. In this manner the resulting signals to be processed are c, x+, x− and y+, y− requiring only three detectors instead of the five detectors required by the assembly described in FIG. 4.

Figure 7:
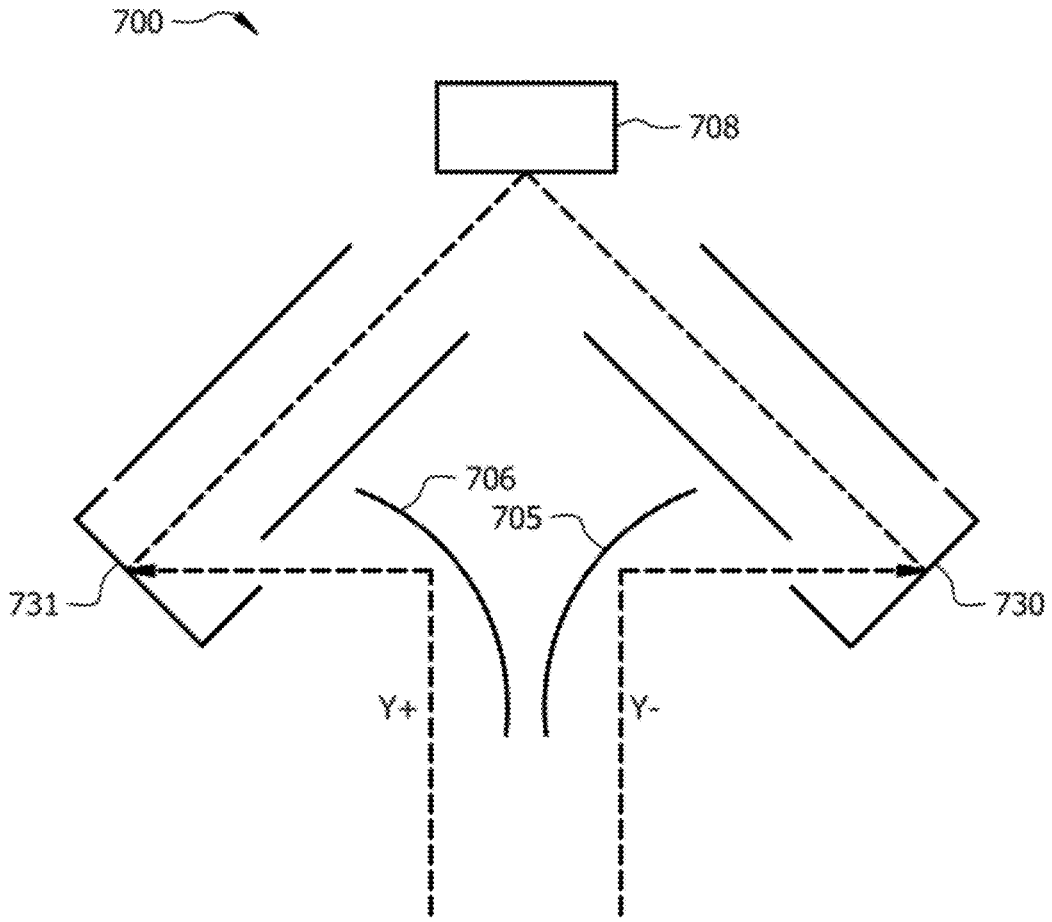
FIG. 7 shows an example of a combiner assembly to combine two separate spatial streams into single signal.

Combining elements 627 and 628 can be any suitable arrangement of elements to redirect separate ion or secondary particle streams into a single signal. Examples of such suitable arrangements are described in U.S. Pat. No. 7,456,398 which is incorporated herein by reference. Referring now to FIG. 7, a basic non-limiting beneficial example embodiment of a combiner assembly 700 according to the concepts described herein is shown. Ion streams y− and y+ hit dynodes 705 and 706 and direct a secondary particle to reflectors 730 and 731 which then direct the streams to common detector 708. The reflection and redirection are performed spatially so as to not interfere with the other ion streams c, x+ and x−. While a simple combiner assembly is shown, any assembly or method for combining disparate streams of ions or a secondary particles resulting from ions is understood to be well within the scope of the concepts described herein.

Figure 8:
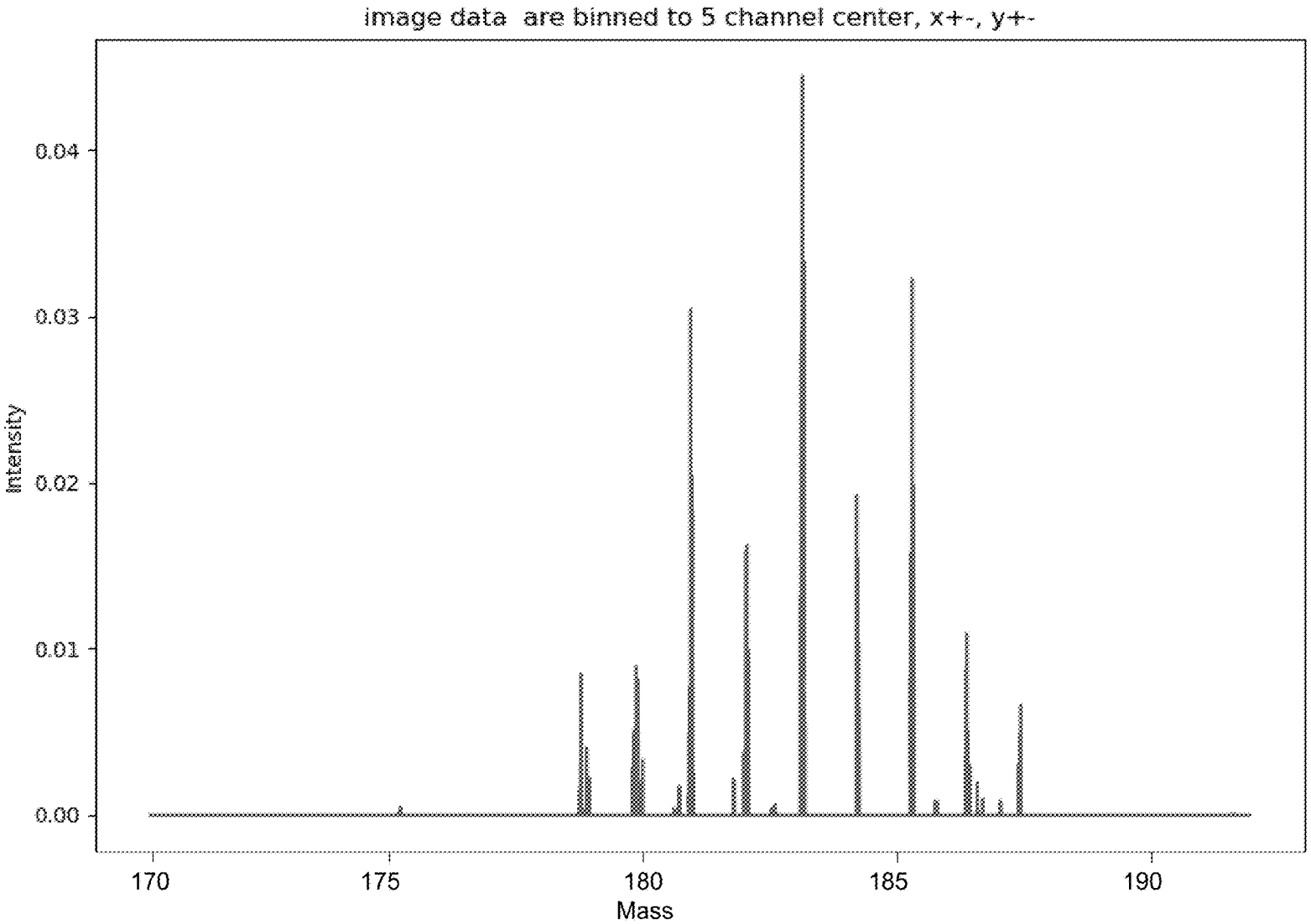
FIG. 8 shows an example of a simulated result of the spatial ion detection system of the present invention.

FIG. 8 shows a basic non-limiting beneficial example embodiment of a data display using the spatial ion detector system according to the concepts described herein.

General Discussion of the Data Processing

The disclosed systems and methods are thus designed to express an observed signal as a linear combination of a mixture of reference signals. In this case, the observed "signal" is the time series of acquired images of ions exiting the quadrupole. The reference signals are the contributions to the observed signal from ions with different m/z values. The coefficients in the linear combination correspond to a mass spectrum.

Reference Signals:

To construct the mass spectrum, it is beneficial to specify, for each m/z value, the signal, the time series of ion images that can be produced by a single species of ions with that m/z value. The approach herein is to construct a canonical reference signal, offline as a calibration step, by observing a test sample and then to express a family of reference signals, indexed by m/z value, in terms of the canonical reference signal.

At a given time, the observed exit cloud image depends upon three parameters—a and q and also the RF phase of the ions as they enter the quadrupole. The exit cloud also depends upon the distribution of ion velocities and radial displacements, with this distribution being assumed to be invariant with time, except for intensity scaling.

The construction of the family of reference signals presents a challenge. Two of three parameters, a and q, that determine the signal depend upon the ratio t/(m/z), but the third parameter depends only on t, not on m/z. Therefore, there is no way simple way to precisely relate the time-series from a pair of ions with arbitrary distinct m/z values.

Fortunately, a countable (rather than continuous) family of reference signals can be constructed from a canonical reference signal by time shifts that are integer multiples of the RF cycle. These signals are good approximations of the expected signals for various ion species, especially when the m/z difference from the canonical signal is small.

To understand why the time-shift approximation works and to explore its limitations, consider the case of two pulses centered at $t_1$ and $t_2$ respectively and with widths of $d_1$ and $d_2$ respectively, where $t_2=kt_1$, $d_2=kt_2$, and $t_1>>d_1$. Further, assume that k is approximately 1. The second pulse can be produced from the first pulse exactly by a dilation of the time axis by factor k. However, applying a time shift of $t_2-t_1$ to the first pulse would produce a pulse centered at $t_2$ with a width of $d_1$, which is approximately equal to $d_2$ when k is approximately one. For low to moderate stability limits (e.g. 10 Da or less), the ion signals are like the pulse signals above, narrow and centered many peak widths from time zero.

Because the ion images are modulated by a fixed RF cycle, the canonical reference signal cannot be related to the signal from arbitrary m/z value by a time shift; rather, it can only be related to signals by time shifts that are integer multiples of the RF period. That is, the RF phase aligns only at integer multiples of the RF period.

The restriction that we can only consider discrete time shifts is not a serious limitation of the disclosed systems and methods. Even in Fourier Transform Mass Spectrometry (FTMS), where the family of reference signals is valid on the frequency continuum, the observed signal is actually expressed in terms of a countable number of sinusoids whose frequencies are integer multiples of 1/T, where T is the duration of the observed signal. In both FTMS and the disclosed methods, expressing a signal that does not lie exactly on an integer multiple, where a reference signal is defined, results in small errors in the constructed mass spectrum. However, these errors are, in general, acceptably small. In both FTMS and in the disclosed methods, the m/z spacing of the reference signals can be reduced by reducing the scan rate. Unlike FTMS, a reduced scan rate in embodiments does not necessarily mean a longer scan; rather, a small region of the mass range can be quickly targeted for a closer look at a slower scan rate.

Returning to the deconvolution problem stated above, it is assumed that the observed signal is the linear combination of reference signals, and it is also assumed that there is one reference signal at integer multiples of the RF period, corresponding to regularly spaced intervals of m/z. The m/z spacing corresponding to an RF cycle is determined by the scan rate.

Matrix equation: The construction of a mass spectrum via embodiments is conceptually the same as in FTMS. In both FTMS and as utilized herein, the sample values of the mass spectrum are the components of a vector that solves a linear matrix equation: Ax=b, as discussed in detail above. Matrix A is formed by the set of overlap sums between pairs of reference signals. Vector b is formed by the set of overlap sums between each reference signal and the observed signal. Vector x contains the set of (estimated) relative abundances. Another solution to the deconvolution problem can use nonnegative deconvolution and convex optimization, as is described in U.S. Patent Application Publication No. 20150311050, the entirety of which is hereby incorporated by reference.

Matrix equation solution: In FTMS, matrix A is the identity matrix, leaving x=b, where b is the Fourier transform of the signal. The Fourier transform is simply the collection of overlap sums with sinusoids of varying frequencies. In embodiments, matrix A is often in a Toeplitz form, as discussed above, meaning that all elements in any band parallel to the main diagonal are the same. The Toeplitz form arises whenever the reference signals in an expansion are shifted versions of each other.

Computational complexity: Let N be denote the number of time samples or RF cycles in the acquisition. In general, the solution of Ax=b has $O(N^3)$ complexity, the computation of A is $O(N^3)$ and the computation of b is $O(N^2)$. Therefore, the computation of x for the general deconvolution problem is $O(N^3)$. In FTMS, A is constant, the computation of b is O(N log N) using the Fast Fourier Transform. Because Ax=b has a trivial solution, the computation is O(N log N). In embodiments, the computation of A is $O(N^2)$ because only 2N−1 unique values need to be calculated, the computation of B is $O(N^2)$, and the solution of Ax=b is $O(N^2)$ when A is a Toeplitz form. Therefore, the computation of x—the mass spectrum—is $O(N^2)$.

The reduced complexity, from $O(N^3)$ to $O(N^2)$ is beneficial for constructing a mass spectrum in real-time. The computations are highly parallelizable and can be implemented on an imbedded GPU. Another way to reduce the computational burden is to break the acquisition into smaller time intervals or "chunks". The solution of k chunks of size N/k results in a k-fold speed-up for an $O(N^2)$ problem. "Chunking" also addresses the problem that the time-shift approximation for specifying reference signals may not be valid for m/z values significantly different from the canonical reference signal.

Further Performance Analysis Discussion

The key metrics for assessing the performance of a mass spectrometer are sensitivity, mass resolving power, and the scan rate. As previously stated, sensitivity refers to the lowest abundance at which an ion species can be detected in the proximity of an interfering species. MRP is defined as the ratio M/DM, where M is the m/z value analyzed and DM is usually defined as the full width of the peak in m/z units, measured at half-maximum (i.e. FWHM). An alternative definition for DM is the smallest separation in m/z for which two ions can be identified as distinct. This alternative definition is most useful to the end user, but often difficult to determine.

In various embodiments, the user can control the scan rate and the DC/RF amplitude ratio. By varying these two parameters, users can trade-off scan rate, sensitivity, and MRP, as described below. The performance is also enhanced when the entrance beam is focused, providing greater discrimination. Further improvement, as previously stated, can be achieved by displacing a focused beam slightly off-center as it enters the quadrupole. When the ions enter off-center, the exit ion cloud undergoes larger oscillations, leading to better discrimination of closely related signals. However, it is to be noted that if the beam is too far off-center, fewer ions reach the detector resulting in a loss of sensitivity.

Scan Rate: Scan rate may be expressed in terms of mass per unit time, but this is only approximately correct. As U and V are ramped, increasing m/z values are swept through the point (q*,a*) lying on the operating line, as shown above in FIG. 2A. When U and V are ramped linearly in time, the value of m/z seen at the point (q*,a*) changes linearly in time, and so the constant rate of change can be referred to as the scan rate in units of Da/s. However, each point on the operating line has a different scan rate. To maintain a constant scan line in a, q space, as well as maintaining a constant MRP, the scan rate in Da/s must increase exponentially with mass.

Sensitivity: Fundamentally, the sensitivity of a quadrupole mass spectrometer is governed by the number of ions reaching the detector. When the quadrupole is scanned, the number of ions of a given species that reach the detector is determined by the product of the source brightness, the average transmission efficiency and the transmission duration of that ion species. The sensitivity can be improved, as discussed above, by reducing the DC/RF line away from the tip of the stability diagram. The average transmission efficiency increases when the DC/RF ratio because the ion spends more of its time in the interior of the stability region, away from the edges where the transmission efficiency is poor. Because the mass stability limits are wider, it takes longer for each ion to sweep through the stability region, increasing the duration of time that the ion passes through to the detector for collection.

Duty Cycle: When acquiring a full spectrum, at any instant, only a fraction of the ions created in the source are reaching the detector; the rest are hitting the rods. The fraction of transmitted ions, for a given m/z value, is called the duty cycle. Duty cycle is a measure of efficiency of the mass spectrometer in capturing the limited source brightness. When the duty cycle is improved, the same level of sensitivity can be achieved in a shorter time, i.e. higher scan rate, thereby improving sample throughput. The duty cycle is the ratio of the mass stability range to the total mass range present in the sample.

By way of a non-limiting example to illustrate an improved duty cycle by use of the methods herein, a user of the disclosed systems and methods can, instead of 1 Da (typical of a conventional system), choose stability limits (i.e., a stability transmission window) of 10 Da (as provided herein) so as to improve the duty cycle by a factor of 10. A source brightness of $10^9$/s is also configured for purposes of illustration with a mass distribution roughly uniform from 0 to 1000, so that a 10 Da window represents 1% of the ions. Therefore, the duty cycle improves from 0.1% to 1%. If the average ion transmission efficiency improves from 25% to nearly 100%, then the ion intensity averaged over a full scan increases 40-fold from $10^9/s*10^{-3}*0.25=2.5*10^5$ to $10^9/s*10^{-2}*1=10^7/s$.

Therefore, suppose a user desires to record 10 ions of an analyte in full-scan mode, wherein the analyte has an abundance of 1 ppm in a sample and the analyte is enriched by a factor of 100 using, for example, chromatography (e.g., 30-second wide elution profiles in a 50-minute gradient). The intensity of analyte ions in a conventional system using the numbers above is $2.5*10^5*10^{-6}*10^2=250/s$. So the required acquisition time in this example is about 40 ms. In various embodiments, the ion intensity is about 40 times greater when using an example 10 Da transmission window, so the required acquisition time in the system described herein is at a remarkable scan rate of about 1 ms.

Accordingly, it is to be appreciated the beneficial sensitivity gain of various embodiments as opposed to a conventional system comes from pushing the operating line downward away from the tip of the stability region, as discussed throughout above, and thus widening the stability limits. In practice, the operating line can be configured to go down as far as possible to the extent that a user can still resolve a time shift of one RF cycle. In this case, there is no loss of mass resolving power; it achieves the quantum limit.

As described above, the disclosed systems and methods can resolve time-shifts along the operating line to the nearest RF cycle. This RF cycle limit establishes the tradeoff between scan rate and MRP, but does not place an absolute limit on MRP and mass precision. The scan rate can be decreased so that a time shift of one RF cycle along the operating line corresponds to an arbitrarily small mass difference.

For example, suppose that the RF frequency is at about 1 MHz. Then, one RF period is 1 us. For a scan rate of 10 kDa/s, 10 mDa of m/z range sweeps through a point on the operating line. The ability to resolve a mass difference of 10 mDa corresponds to a MRP of 100 k at m/z 1000. For a mass range of 1000 Da, scanning at 10 kDa/s produces a mass spectrum in 100 ms, corresponding to a 10 Hz repeat rate, excluding interscan overhead. Similarly, the disclosed systems and methods can trade off a factor of x in scan rate for a factor of x in MRP. Accordingly, various embodiments can be configured to operate at 100 k MRP at 10 Hz repeat rate, "slow" scans at 1M MRP at 1 Hz repeat rate, or "fast" scans at 10 k MRP at 100 Hz repeat rate. In practice, the range of achievable scan speeds may be limited by other considerations such as sensitivity or electronic stability.

Exemplary Modes of Operation

As one embodiment, the system can be operated in $MS^1$ "full scan" mode, in which an entire mass spectrum is acquired, e.g., a mass range of 1000 Da or more. In such a configuration, the scan rate can be reduced to enhance sensitivity and mass resolving power (MRP) or increased to improve throughput. Because the disclosed system provides for high MRP at relatively high scan rates, it is possible that scan rates are limited by the time required to collect enough ions, despite the improvement in duty cycle over conventional methods and instruments.

Other embodiments can also be operated in a "selected ion mode" (SIM) in which one or more selected ions are targeted for analysis. Conventionally, a SIM mode, as stated previously, is performed by parking the quadrupole, i.e. holding U and V fixed. By contrast, the disclosed system scans U and V rapidly over a narrow mass range, and using wide enough stability limits so that transmission is about 100%. In selected ion mode, sensitivity requirements often dictate the length of the scan. In such a case, a very slow scan rate over a small m/z range can be chosen to maximize MRP. Alternatively, the ions can be scanned over a larger m/z range, i.e. from one stability boundary to the other, to provide a robust estimate of the position of the selected ion.

As also stated previously, hybrid modes of $MS^1$ operation can be implemented in which a survey scan for detection across the entire mass spectrum is followed by multiple target scans to hone in on features of interest. Target scans can be used to search for interfering species and/or improve quantification of selected species. Another possible use of the target scan is elemental composition determination. For example, the quadrupole can target the "A1" region, approximately one Dalton above the monoisotopic ion species to characterize the isotopic distribution. For example, with an MRP of 160 k at m/z 1000, it is possible to resolve C-13 and N-15 peaks, separated by 6.3 mDa. The abundances of these ions provide an estimate of the number of carbons and nitrogens in the species. Similarly, the A2 isotopic species can be probed, focusing on the C-13, S-34 and O-18 species.

In a triple quadrupole configuration, the position-sensitive detector, as described above, can be placed at the exit of Q3. The other two quadrupoles, Q1 and Q2, are operated in a conventional manner, i.e., as a precursor mass filter and collision cell, respectively. To collect $MS^1$ spectra, Q1 and Q2 allow ions to pass through without mass filtering or collision. To collect and analyze product ions, Q1 can be configured to select a narrow range of precursor ions (i.e. 1 Da wide mass range), with Q2 configured to fragment the ions, and Q3 configured to analyze the product ions.

Q3 can also be used in full-scan mode to collect (full) MS/MS spectra at 100 Hz with 10 k MRP at m/z 1000, assuming that the source brightness is sufficient to achieve acceptable sensitivity for 1 ms acquisition. Alternatively, Q3 can be used in SIM mode to analyze one or more selected product ions, i.e., single reaction monitoring (SRM) or multiple reaction monitoring (MRM). Sensitivity can be improved by focusing the quadrupole on selected ions, rather than covering the whole mass range.

It is to be understood that features described with regard to the various embodiments herein may be mixed and matched in any combination without departing from the spirit and scope of the disclosure. Although different selected embodiments have been illustrated and described in detail, it is to be appreciated that they are exemplary, and that a variety of substitutions and alterations are possible without departing from the spirit and scope of the present disclosure.

What is claimed is:

1. A mass spectrometer, comprising:

a multipole configured to pass an ion stream, the ion stream comprising an abundance of one or more ion species within stability boundaries defined by (a, q) values;

a detector configured to detect the spatial and temporal properties of the abundance of ions, wherein the detector comprises a plurality of dynodes, each dynode arranged such that it is struck by ions in a known spatial relationship with the ion stream and the detector further comprises a plurality of charged particle detectors, each of the plurality of charged particle detectors associated with one or more of the plurality of dynodes, wherein the plurality of dynodes in the detector is five dynodes, a first dynode of the five dynodes arranged to be struck by ions in the center of the ion stream, a second dynode being configured to be struck by ions in a y+ portion of the ion stream, a third dynode being configured to be struck by ions in a y− portion of the ion stream, a fourth dynode being configured to be struck by ions in a x+ portion of the ion stream, and a fifth dynode being configured to be struck by ions in a x− portion of the ion stream, wherein the second dynode, third dynode, fourth dynode and fifth dynode are arranged a pyramidal form with an aperture associated with the first dynode; and a processing means configured to record and store a pattern of detection of ions in the abundance of ions by the dynodes in the detector.

2. The mass spectrometer of claim 1, wherein each of the five dynodes is associated with a charged particle detector.

3. The mass spectrometer of claim 1, wherein the plurality of dynodes in the detector is three dynodes, a first dynode of the three dynodes arranged to be struck by ions in the center of the ion stream, a second dynode being configured to be struck by ions in either a y+ portion of the ion stream or an x+ portion of the ion stream, and a third dynode being configured to be struck by ions in either a y− portion of the ion stream or an x− portion of the ion stream.

4. The mass spectrometer of claim 1, wherein said multipole further comprises a quadrupole.

5. The mass spectrometer of claim 1, wherein the charged particle detectors include electron multipliers, photomultipliers, silicon photomultipliers, avalanche photodiodes, or any combination thereof.

6. The mass spectrometer of claim 1, wherein said mass spectrometer is configured to operate in a full scan mode, product ion scan mode, single ion monitoring mode, single reaction monitoring mode, or any combination thereof.

7. A method of determining spatial information in a multipole mass spectrometer, the method comprising:

operating a multipole to pass an ion stream, the ion stream comprising an abundance of one or more ion species within stability boundaries defined by (a, q) values;

detecting the spatial and temporal properties of the abundance of ions using a detector, wherein the detector comprises a plurality of dynodes, each dynode arranged such that it is struck by ions in a known spatial relationship with the ion stream, the detector further comprising a plurality of charged particle detectors, each of the plurality of charged particle detectors associated with one or more of the plurality of dynodes, wherein the plurality of dynodes in the detector is five dynodes, a first dynode of the five dynodes arranged to be struck by ions in the center of the ion stream, a second dynode being configured to be struck by ions in a y+ portion of the ion stream, a third dynode being configured to be struck by ions in a y− portion of the ion stream, a fourth dynode being configured to be struck by ions in a x+ portion of the ion stream, and a fifth dynode being configured to be struck by ions in a x− portion of the ion stream, wherein the second dynode, third dynode, fourth dynode and fifth dynode are arranged a pyramidal form with an aperture associated with the first dynode; and storing a pattern of detection of ions in the abundance of ions by the dynodes in the detector.

8. The method of claim 7, wherein each of the five dynodes is associated with a charged particle detector.

9. The method of claim 7, wherein the first dynode is associated with a first charged particle detector, the second and third dynodes are associated with a second charged particle detector and the fourth and fifth dynodes are associated with a third charged particle detector.

10. The method of claim 7, wherein said multipole further comprises a quadrupole.

11. A mass spectrometer, comprising:

a multipole configured to pass an ion stream, the ion stream comprising an abundance of one or more ion species within stability boundaries defined by (a, q) values;

a plurality of dynodes to detect the abundance of ions based on each ion's spatial location in the ion stream, the plurality of dynodes comprising a first dynode arranged to be struck by ions in the center of the ion stream, a second dynode being configured to be struck by ions in a y+ portion of the ion stream, a third dynode being configured to be struck by ions in a y− portion of the ion stream, a fourth dynode being configured to be struck by ions in a x+ portion of the ion stream, and a fifth dynode being configured to be struck by ions in a x− portion of the ion stream, wherein the second dynode, third dynode, fourth dynode and fifth dynode are configured in a pyramidal arrangement with an aperture associated with the first dynode;

a plurality of charged particle detectors, each of the plurality of charged particle detectors associated with one or more of the plurality of dynodes; and a processor configured to record and store a pattern of detection of ions in the abundance of ions by the plurality of dynodes in the detector.

12. The mass spectrometer of claim 11, wherein each of the five dynodes is associated with a charged particle detector.

13. The mass spectrometer of claim 11, wherein the first dynode is associated with a first charged particle detector, the second and third dynodes are associated with a second charged particle detector and the fourth and fifth dynodes are associated with a third charged particle detector.

14. The mass spectrometer of claim 11, wherein said multipole further comprises a quadrupole.

15. The mass spectrometer of claim 11, wherein said mass spectrometer is configured to operate in a full scan mode.

* * * * *